US007301471B1

(12) United States Patent
Specht

(10) Patent No.: US 7,301,471 B1
(45) Date of Patent: Nov. 27, 2007

(54) COMMUNICATIONS MONITOR AND CONTROL FOR CONSUMER DEVICES

(75) Inventor: Philip R. Specht, Roswell, GA (US)

(73) Assignee: AT&T Mobility II LLC, Atlanta, GA (US)

( * ) Notice: Subject to any disclaimer, the term of this patent is extended or adjusted under 35 U.S.C. 154(b) by 483 days.

(21) Appl. No.: 10/989,518

(22) Filed: Nov. 17, 2004

(51) Int. Cl.
*G08C 19/00* (2006.01)

(52) U.S. Cl. ..... 340/825.72; 340/7.58; 340/539.11; 340/691.1; 455/420

(58) Field of Classification Search ..... 340/539.11, 340/573.1, 825.19, 7.1, 7.2, 7.58–7.62, 825.69, 340/825.72, 691.1; 455/404.1, 420; 381/315; 341/176

See application file for complete search history.

(56) References Cited

U.S. PATENT DOCUMENTS 6,353,413 B1 * 3/2002 White et al. ..... 342/453
6,445,933 B1 * 9/2002 Pettit ..... 455/556.1
6,545,587 B1 * 4/2003 Hatakeyama et al. .. 340/825.69
6,640,144 B1 * 10/2003 Huang et al. ..... 340/825.69
6,791,467 B1 * 9/2004 Ben-Ze'ev ..... 340/825.69
2004/0027495 A1 * 2/2004 Ferris ..... 348/734

FOREIGN PATENT DOCUMENTS

JP 2003037749 A * 2/2003
JP 2003102073 A * 4/2003
JP 2003174687 A * 6/2003
JP 2003264613 A * 9/2003
JP 2004186889 A * 7/2004
JP 2004242200 A * 8/2004
WO WO 200127895 A1 * 4/2001

* cited by examiner

*Primary Examiner*—Thomas Mullen
(74) *Attorney, Agent, or Firm*—Gardner Groff Greenwald & Villanueva, P.C.

(57) ABSTRACT

A method and apparatus which provide for simultaneously monitoring and controlling multiple consumer devices located in a fixed and/or mobile environment includes a handheld RF communications device having multiple controls. In addition, a transceiver device is provided which simultaneously a) receives output signals from selected ones of the consumer devices and transmits the received output signals as radio frequency signals to the handheld communications device, and b) receives control signals from the handheld communications device, and relays the control signals to an associated consumer device to control the associated consumer device.

10 Claims, 1 Drawing Sheet

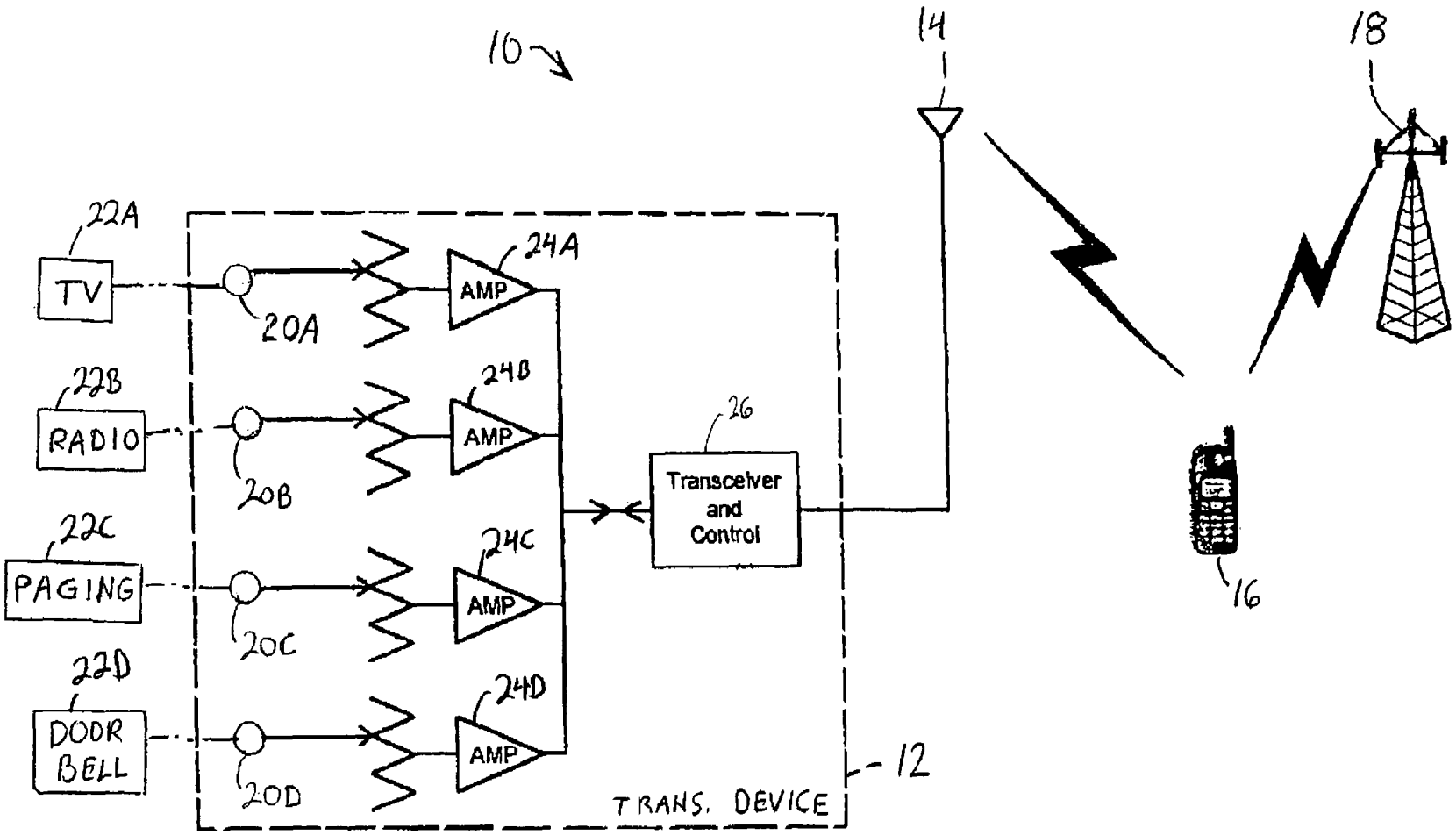
10
18
16
14
12
TRANS. DEVICE
26
Transceiver and Control
24A
24B
24C
24D
AMP
AMP
AMP
AMP
20A
20B
20C
20D
22A
TV
22B
RADIO
22C
PAGING
22D
DOOR BELL

COMMUNICATIONS MONITOR AND CONTROL FOR CONSUMER DEVICES

BACKGROUND OF THE INVENTION

1. Field of Invention

This invention relates generally to a system and method for controlling and monitoring a consumer device, and more particularly to a system and method which simultaneously controls and monitors multiple consumer devices located within a fixed environment.

2. Description of Related Art

Many consumer devices, such as TVs, radios, CD players, VCRs, DVD players, digital player/recorders, computers, etc. come with remote controls. In order to cut down on the number of control devices which must be associated with numerous consumer devices, universal remote controls and the like have been provided which will control various typically related consumer devices. For example, a remote control which selectively controls a TV, and various consumer products associated therewith (such as one or more of a video player/recorder, CD player, DVD player, cable satellite receiver, cable box receiver, and the like) have been in common use.

While such remote controls have been useful, it has not been convenient or possible to control or monitor other devices therewith, particularly when out of sight thereof.

In addition, many other consumer devices, such as doorbells, pagers or wireless intercoms, produce output signals which are received by the user either directly or on a dedicated receiver. Such devices are not usable with universal remotes.

SUMMARY OF THE INVENTION

One benefit of this invention is to provide a method and system for simultaneously monitoring and controlling multiple consumer devices which are located in a fixed environment.

Another benefit of the invention is that the simultaneous monitoring and controlling is accomplished using a handheld communications device, such as a cellular telephone.

In the illustrated embodiment, a method and apparatus for simultaneously monitoring and controlling multiple consumer devices located in a fixed environment is disclosed. To accomplish this, a handheld RF communications device having multiple controls is provided. In addition, a transceiver device is provided which simultaneously a) receives output signals from selected ones of the consumer devices and transmits the received output signals as radio frequency signals to said handheld communications device, and b) receives control signals from the handheld communications device, and relays the control signals to an associated consumer device to control the associated consumer device.

It is also a benefit of the present invention to provide, where the user is hard of hearing or the like, a system and method whereby the user can be vigilant at all times of the consumer devices in an environment.

Other objects and features of the present invention are stated in or apparent from detailed descriptions of an embodiment of the invention found hereinbelow.

BRIEF DESCRIPTION OF THE DRAWING

An exemplary embodiment will be described in detail, wherein like reference numerals refer to identical or similar components or steps, with reference to the following FIGURE, wherein:

the single FIGURE illustrates a schematic representation of an exemplary embodiment of a communications control system in accordance with the present invention.

DETAILED DESCRIPTION OF THE INVENTION

A method and system for controlling and monitoring consumer devices are described hereafter. In the following detailed description of the present invention, numerous specific details are set forth in order to provide a thorough understanding of the present invention. However, it will be apparent to one skilled in the art that the present invention may be practiced without these specific details. In some instances, well-known structures and devices are shown in block diagram form rather than detail, in order to avoid obscuring the present invention.

This invention should not be construed as limited to the embodiments set forth herein. Rather, these embodiments are provided so that this disclosure will fully convey the scope of the invention to those skilled in the art. In the drawings, like numbers refer to like elements.

It also will be understood that, as used herein, the term "comprising" or "comprises" is open-ended, and includes one or more stated elements, steps and/or functions without precluding one or more unstated elements, steps and/or functions.

The present invention is described below with reference to block diagrams and/or operational illustrations of methods and wireless terminals according to embodiments of this invention. It is understood that each block of the block diagrams and/or operational illustrations, and combinations of the blocks in the block diagram and/or operational illustrations, can be implemented by radio frequency, analog and/or digital hardware, and/or computer program instructions. These computer program instructions may be provided to a processor of a general-purpose computer, special purpose computer, ASIC (application-specific integrated circuit), and/or other programmable processing apparatus; and these computer program instructions create means for implementing the functions/acts specified in the block diagrams and/or operational block or blocks.

The single FIGURE schematically illustrates an exemplary embodiment of a communications control system 10 in accordance with the present invention which includes a transceiver device 12. As shown, transceiver device 12 communicates through an antenna 14 with a handheld RF communications device 16, which in the preferred embodiment is a cellular or mobile telephone. Handheld communications device 16 communicates with a cell tower 18 of a typical wireless network (not otherwise shown but as well known in the art), and in the present invention handheld communications device 16 is also adapted to communicate with transceiver device 12 via antenna 14. It will be appreciated that handheld communications device 16 includes multiple receivers and transmitters besides those normally provided for wireless telephone communications, as well as numerous different control buttons and function operation schemes which could be provided therewith or programmed therein. By way of example, handheld communications device 16 could be a device similar in design to the NOKIA 6800® mobile telephone but with additional transmitters and controls. Thus, it will be appreciated that various communications can take place with handheld communications device 16 simultaneously.

As shown, transceiver device 12 includes a plurality of input/output connections 20, such as exemplary i/o connections 20A, 20B, 20C and 20D shown, for signals from various consumer devices 22, such as TV 22A, radio 22B, paging system 22C, and door bell 22D as shown. All of consumer devices 22 would be located in a defined environment, such as a house or an office, and the environment would include areas immediately adjacent to a house or office if desired. While only four i/o connections 20 are shown, it will be appreciated that typically many more i/o connections 20 would be provided so as to accommodate a large number and variety of consumer devices 22 besides those exemplarily depicted, such as additionally for a CD player, a DVD player, a VCR, a TV cable or satellite receiver box, a computer, a door bell, an alarm system, a multimedia center, lighting, cooking appliances, HVAC, ceiling fan, etc. I/o connections 20 could also accommodate more than one type of consumer device, such as for two or more different TVs, if desired and present in the environment.

Each i/o connection 20 is preferably connected to an associated amplifier 24, such as amplifiers 24A, 24B, 24C, and 24D shown, in order to suitably amplify any output signal received from the associated consumer device 22. The amplified signal is then connected to an RD transceiver/controller module 26 which is in turn connected to antenna 14. T/c module 26 takes the output signal from each (and every) consumer device 22, and simultaneously transmits as required a representation thereof to handheld communications device 16 over an RF frequency, either licensed or unlicensed as required. Examples of output signals which would be communicated to handheld communications device 16, and responses thereto available through handheld communications device 16 are as follows.

| OUTPUT SIGNAL | RESPONSE |
|---|---|
| door bell is ringing | activating an intercom at the door |
| alarm is sounding (fire, break-in, smoke, etc.), or activated | turning off an alarm or calling police/fire |
| landline telephone is ringing | answering landline phone |
| intercom is being activated | answering intercom |
| email has arrived at a computer | reading email |
| paging has occurred | view paging message, or answer page |

In addition to receiving output signals from transceiver device 12 and responding thereto with control signals for the consumer device 22, it will be appreciated that handheld communications device 16 is also usable to initiate a full (or limited) range of the usual control signals for a variety of designated consumer devices 22 as well via t/c module 26 with user initiated signals sent from handheld communications device 16 and received by antenna 14. Examples of consumer devices 22 which would be controlled as well by handheld communications device 16 with initiated control signals are as follows: TV, radio, CD, DVD, VCR, multimedia center, ceiling fan, etc. In order to provide the variety of needed controls, it will be appreciated that handheld communications device 16 is designed to be programmable or to have programs for various consumer devices 22 as known in the art.

In the preferred embodiment, transceiver device 12 is also designed to serve as a repeater for communications between two or more associated portable to portable consumer devices 22 as well, using licensed or unlicensed frequencies as desired or needed.

In the method of use of the present invention, the user would be provided with handheld communications device 16 which would be suitably designed and programmed for use with transceiver device 12. It is envisioned that the present invention would be especially useful by users who are hard of hearing, as they would particularly have trouble hearing various other device sounds when, for example, they are watching TV with the sound therefor already turned up high. Thus, in such a situation where the user is watching TV, if the door bell rang, the signal therefor would be supplied as well to transceiver device 12 which would then transmit a door bell ringing signal to handheld communications device 16. As handheld communications device 16 would be kept in close proximity to the user (especially if they are hard of hearing), the user would thus easily hear the associated signal for the door bell ringing or the like received by communications device 16. The user could then, for example, send a control signal from handheld communications device 16 through transceiver device 12 to mute the sound of the TV; and then answer the door bell by initiating an intercom system for the door using handheld communications device 16 through transceiver device 12. Preferably, the volume of sounds emitted by handheld communications device 16 would also be adjustable so that the hard of hearing could set the volume in accordance with their needs.

It will be appreciated that control system 10 is designed so that output signals from various devices can be simultaneously transmitted to handheld communications device 16. Thus, even though communications device 16 is, for example, being used to control a television or as a cellular telephone, any output signal could be sent thereto during such operations. This would be especially important to those hard of hearing, as otherwise such an output signal as an alarm might not otherwise be heard.

It will also be appreciated that control system 10 is designed to be added to the usual control schemes for the consumer devices 22. Thus, the usual provided controls and remote controls for such devices would still be usable. It will further be appreciated that rather than having an audio signal issue from handheld communications device 16 when an output signal is received, handheld communications device could produce a visual or vibratory signal instead or additionally—which would be additionally helpful for the hard of hearing.

If desired, transceiver device 12 could also be combined to make use of the FastForward® type of technology. Thus, communications device 16 could be further tied to the local landline telephone so that telephone calls directed to handheld communications device 16 would be forwarded to the landline telephone, and from there to handheld communications device 16 without using wireless minutes.

Although the invention is described above for use with multiple consumer devices within a fixed environment, it will be appreciated that there could also be embodiments of the invention that are used in a mobile environment. For example, one such mobile environment where the present invention would find utility is a car or SUV. In such an environment, a passenger in the car or SUV could monitor/control devices therein, such as: reading the output screen of a Global Positioning System for directions, controlling stations on a satellite or radio receiver, and/or listening discreetly to a radio station with his handheld device without disturbing others. It will also be appreciated that the present invention is usable with multiple handheld devices 16 and hence multiple simultaneous users who could, for example, be in different rooms watching a respective TV.

While the present invention has been described above with respect to an exemplary embodiment of the invention, other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A communications system for simultaneously monitoring and controlling multiple consumer devices located in a fixed environment, said system comprising:

a cellular telephone device having multiple controls through which a user can control both telephone calls and consumer devices; and a transceiver device physically separate from the cellular telephone device and coupleable in electronic signal communication with a plurality of consumer devices physically separate from the transceiver device, wherein the transceiver device simultaneously a) receives output signals from user-selected ones of the consumer devices and transmits the received output signals as radio frequency signals to said cellular telephone device, and b) receives user-input control signals from the cellular telephone device, and relays the control signals to an associated consumer device to control the associated consumer device.

2. A communications control system as claimed in claim 1, wherein said transceiver device includes inputs for the output signals which amplify the inputted signals from the consumer devices.

3. A communications control system as claimed in claim 1, wherein said cellular telephone device has multiple receivers and transmitters.

4. A communications control system as claimed in claim 1, wherein said transceiver device is also a repeater which receives an output control signal from one consumer device and relays the output control signal wirelessly to a predetermined consumer device.

5. A communications control system as claimed in claim 1, wherein said transceiver device includes inputs for consumer devices selected from a plurality of; a TV, a radio, a CD player, a DVD player, a computer, a door bell, an alarm system, a multimedia center, a paging system, and an intercom.

6. A method for simultaneously monitoring and controlling multiple consumer devices located in a fixed environment, said method comprising the steps of:

providing a cellular telephone device having controls through which a user can control both telephone calls and consumer devices; and relaying signals between the cellular telephone device and a plurality of the consumer devices through a transceiver device, wherein the transceiver device is a physically separate element from the cellular telephone device and consumer devices, and wherein the transceiver device communicates the signals by a) receiving output signals from user-selected ones of the consumer devices and then transmitting the received output signals as radio frequency signals to the cellular telephone device; and b) receiving user-input control signals from the cellular telephone device and relaying the received control signals to an associated consumer device to control the associated consumer device.

7. A method for monitoring and controlling multiple consumer devices as claimed in claim 6, wherein said receiving output signals step includes the step of amplifying the outputted signals from the consumer devices.

8. A method for monitoring and controlling multiple consumer devices as claimed in claim 6, wherein the provided cellular telephone device has multiple receivers and transmitters.

9. A method for monitoring and controlling multiple consumer devices as claimed in claim 6, further including the step of wirelessly repeating with the transceiver an output control signal from one consumer device to a predetermined associated consumer device.

10. A method for monitoring and controlling multiple consumer devices as claimed in claim 6, wherein said receiving from and relaying to steps are associated with consumer devices selected from a plurality of; a TV, a radio, a CD player, a DVD player, a computer, a door bell, an alarm system, a multimedia center, a paging system, and an intercom.

* * * * *